US005906569A

United States Patent [19]

Ratzel

[11] Patent Number: 5,906,569

[45] Date of Patent: May 25, 1999

[54] CONVERSION MACHINE AND METHOD FOR MAKING FOLDED STRIPS

[75] Inventor: Richard O. Ratzel, Westlake, Ohio

[73] Assignee: Ranpak Corp., Concord Township, Ohio

[21] Appl. No.: 08/941,519

[22] Filed: Sep. 30, 1997

[51] Int. Cl.[6] ..... B31B 1/14

[52] U.S. Cl. ..... 493/363; 493/365; 493/367; 493/464; 493/471

[58] Field of Search ..... 493/464, 967, 493/407, 471, 475, 478, 363, 364, 365, 366, 367, 368, 369, 370, 371

[56] References Cited

U.S. PATENT DOCUMENTS

| | | | |
|---|---|---|---|
| 940,862 | 11/1909 | Bullock | 83/501 |
| 1,525,590 | 2/1925 | Perrault | 83/501 |
| 1,680,203 | 8/1928 | Cannard | 493/407 |
| 1,730,006 | 10/1929 | Harrold | 83/664 |
| 1,939,246 | 12/1933 | Atonsen | 83/664 |
| 2,006,106 | 6/1935 | Markert | 83/501 |
| 2,191,148 | 2/1940 | Perbal | 83/664 |
| 2,271,180 | 1/1942 | Brugger . | |
| 2,537,026 | 1/1951 | Brugger . | |
| 2,770,302 | 11/1956 | Lee | 493/365 |
| 3,033,064 | 5/1962 | Lee | 493/365 |
| 3,161,364 | 12/1964 | House | 83/564 |
| 3,286,574 | 11/1966 | Durand | 83/501 |
| 3,503,293 | 3/1970 | Sander | 83/564 |
| 4,275,630 | 6/1981 | Goldsmith | 83/664 |
| 4,280,690 | 7/1981 | Hill . | |
| 4,330,092 | 5/1982 | Roman | 83/501 |
| 4,381,107 | 4/1983 | Armiger . | |
| 4,411,391 | 10/1983 | Crane | 83/501 |
| 4,506,577 | 3/1985 | Shinomiya | 83/564 |
| 4,674,375 | 6/1987 | Golicz . | |
| 4,690,344 | 9/1987 | Yokota . | |
| 4,732,337 | 3/1988 | Knecht | 83/664 |
| 4,846,778 | 7/1989 | Hirakawa | 493/367 |
| 4,901,993 | 2/1990 | Hansch . | |
| 4,982,907 | 1/1991 | Sedgwick | 83/664 |
| 5,088,972 | 2/1992 | Parker . | |
| 5,134,013 | 7/1992 | Parker . | |
| 5,135,178 | 8/1992 | Strohmeyer | 83/501 |
| 5,173,352 | 12/1992 | Parker . | |
| 5,186,090 | 2/1993 | Bunch | 83/241 |
| 5,340,638 | 8/1994 | Sperner | 493/967 |
| 5,374,233 | 12/1994 | Lehmann | 493/477 |
| 5,403,259 | 4/1995 | Parker . | |
| 5,439,730 | 8/1995 | Kelly | 493/967 |
| 5,573,491 | 11/1996 | Parker . | |
| 5,656,008 | 8/1997 | Beierlorzer . | |

*Primary Examiner*—James F. Coan
*Assistant Examiner*—Gene L. Kim
*Attorney, Agent, or Firm*—Renner, Otto, Boisselle & Sklar, P.L.L.

[57] ABSTRACT

A machine and method for making folded strips, which machine and method are characterized by features that enable a reduction in the size, weight and cost of the machine. The machine and method comprises a housing having first and second housing sections, a longitudinal severing assembly for longitudinally severing the sheet stock material into a plurality of strips, and a folding device downstream of the longitudinal severing assembly and operative to cause back and forth folding of the strips to produce accordion-folded strips having substantially uniform adjacent opposite folds. The longitudinal severing assembly includes first and second slitting members respectively carried in the first and second housing sections, and the first and second housing sections are separable whereby the housing is openable to maintain and repair the machine. The slitting members include a shaft and an array of slitting discs carried on the shaft for rotation therewith. The slitting discs are individually axially shiftable relative to the shaft and a biasing member is used to resiliently bias the slitting discs towards one another to hold the same assembled as a stacked array. Also provided are first and second arrays of combers passing through respective spaces between relatively adjacent cutting discs of the first and second slitting members, respectively. The first and second array of combers define therebetween a passageway which directs the sheet stock material between the first and second slitting members, and the combers each are in the form of an elongated member having an inner surface defining a part of one side of the passageway and an outer surface disposed inwardly of the rotation axis of the respective slitting member at the same side of said passageway as the comber.

6 Claims, 15 Drawing Sheets

MATCH TO FIG.7A

CONVERSION MACHINE AND METHOD FOR MAKING FOLDED STRIPS

FIELD OF THE INVENTION

The invention herein described relates generally to a conversion machine and method for making folded strips from sheet material and, more particularly, resilient folded strips from one or more plies of paper.

BACKGROUND OF THE INVENTION

Accordion-folded paper strips heretofore have been used as decorative packaging, dunnage, void-fill and other cushioning products. Accordion-folded paper strips have also recently found uses in other fields, such as the agricultural and veterinary fields.

Machines and methods for making such folded strips are disclosed in U.S. Pat. Nos. 5,088,972; 5,134,013; 5,173,352; 5,403,259; 5,573,491 and 5,656,008; and in U.S. patent application Ser. No. 08/153,360. In these machines and methods, a continuous sheet of material is separated into a plurality of strips and folded into a zig-zag or accordion shape. The folding may be accomplished by advancing the plurality of strips against a restrained body of previously folded strips in such a manner that the natural resilience of the material produces adjacent opposite folds thereby causing the strips to assume a zig-zag shape. The separation of the sheet of material into strips is accomplished by transverse separation of the sheet into lengths which define the lengths of the strips and longitudinal separation of the sheet which defines the width of the strip. The width of the folded strip will be approximately the same as the width of the unfolded strip. The length of the folded strip will be somewhat shorter than the length of the unfolded strip.

The separation of the continuous sheet of material into a plurality of strips has been accomplished by several methods of longitudinal and then transverse separation. For example, in U.S. Pat. Nos. 5,088,972 and 5,134,013, a machine and method is disclosed in which a continuous sheet or web of material is first longitudinally cut into longitudinal sections. These longitudinal sections are folded and then the folded sections are transversely separated into strips to form a plurality of folded strips. Thus, the continuous sheet of material is longitudinally separated and then subsequently transversely separated into folded strips.

Alternatively, in U.S. Pat. Nos. 5,173,352 and 5,403,259, a machine and method is disclosed in which the leading end of the continuous sheet of paper is completely transversely separated from the rest of the sheet of paper to define a leading sheet portion. This leading sheet portion is then fed to a longitudinal slitting assembly for longitudinal separation of the sheet into strips which are then folded into folded strips. Thus, the continuous sheet of material is transversely separated and subsequently longitudinally separated into strips which are then folded into folded strips having the same or a specified unfolded length.

Folded strips also have heretofore been produced using a combination of machines. A first machine, known as a crepe converter machine, impels a continuous sheet of paper through transverse restricting fingers and wrinkles the paper, thereby producing a creped/crimped sheet. In a second machine, the creped/crimped sheet is longitudinally slit and transversely cut to form folded strips. In still another arrangement, a corrugator machine is used in place of the crepe converter machine. In the corrugator machine, the continuous sheet of paper is passed between cooperating corrugating rollers that produce corrugating in the paper.

The corrugated paper may then be wound into a roll and later supplied to slitting and cutting equipment which longitudinally slits and transversely cuts the corrugated paper sheet into strips.

The aforesaid machines or machine combinations are of considerable size, weight and cost. Thus, heretofore these machines have been located at a few manufacturing facilities and the folded strips have been shipped in boxes or bags to customers who may be located a considerable distance from the manufacturing facility. This results in high transportation costs considering that the folded strips occupy a substantial volume requiring a lot of room in the truck or other transport vehicle. Therefore, it would be advantageous to have a machine and associated method for producing the folded strips that is significantly smaller, lighter and less expensive then presently known machines. Thus, for a given investment more machines could be located at respective strategically located manufacturing and/or end user facilities, thereby substantially reducing shipping costs of the converted product.

SUMMARY OF THE INVENTION

The present invention provides a machine and method for making folded strips, which machine and method are characterized by features that enable a reduction in the size, weight and cost of the machine.

According to one aspect of the invention, a machine and method for producing accordion-folded strips from sheet stock material are characterized by a housing having first and second housing sections, a longitudinal severing assembly for longitudinally severing the sheet stock material into a plurality of strips, and a folding device downstream of the longitudinal severing assembly and operative to cause back and forth folding of the strips to produce accordion-folded strips having substantially uniform adjacent opposite folds. The longitudinal severing assembly includes first and second slitting members respectively carried in the first and second housing sections, and the first and second housing sections are separable whereby the housing is openable to maintain and repair the machine.

According to another aspect of the invention, a machine and method for producing accordion-folded strips from sheet stock material comprises a longitudinal severing assembly for longitudinally severing the sheet stock material into a plurality of strips; and a folding device downstream of the longitudinal severing assembly and operative to cause back and forth folding of the strips to produce accordion-folded strips having substantially uniform adjacent opposite folds. The longitudinal severing assembly includes at least one rotating slitting member including a shaft and an array of slitting discs carried on the shaft for rotation therewith. The slitting discs are individually axially shiftable relative to the shaft and a biasing member is used to resiliently bias the slitting discs towards one another to hold the same assembled as a stacked array.

According to still another aspect of the invention, a machine and method for producing accordion-folded strips from sheet stock material comprises a longitudinal severing assembly for longitudinally severing the sheet stock material into a plurality of strips and a folding device downstream of the longitudinal severing assembly and operative to cause back and forth folding of the strips to produce accordion-folded strips having substantially uniform adjacent opposite folds. The longitudinal severing assembly includes first and second slitting members each including an array of slitting discs that partially overlap and are interleaved with the slitting discs of the other slitting member. Also provided are first and second arrays of combers passing through respective spaces between relatively adjacent cutting discs of the first and second slitting members, respectively. The first and second array of combers define therebetween a passageway which directs the sheet stock material between the first and second slitting members, and the combers each are in the form of an elongated member having an inner surface defining a part of one side of the passageway and an outer surface disposed inwardly of the rotation axis of the respective slitting member at the same side of said passageway as the comber.

In a preferred embodiment, the folding device functions to restrict forward movement of unfolded strips passing from the slitting members in such a manner that the strips are caused to fold back and forth to produce accordion-folded strips having substantially uniform adjacent opposite folds.

According to a further aspect of the invention, a packaging system comprises a machine for producing accordion-folded strips from sheet stock material, a receptacle for receiving the accordion-folded strips from the machine and in which the accordion-folded strips are retained in a relatively uncompressed state, and a packaging surface adjacent the receptacle for supporting a container in which one or more products are to be packed and cushioned by said accordion-folded strips.

According to yet another aspect of the invention, a packing method comprises the steps of producing accordion-folded strips from sheet stock material, delivering the accordion-folded strips to a packaging station in a relatively uncompressed state, positioning at the packaging station a container in which one or more products are to be packed and cushioned by said accordion-folded strips, and placing the strips in the container.

The foregoing and other features of the invention are hereinafter fully described and particularly pointed out in the claims, the following description and the annexed drawings setting forth in detail one or more illustrative embodiments of the invention, such being indicative, however, of but one or a few of the various ways in which the principles of the invention may be employed.

DETAILED DESCRIPTION OF THE INVENTION

Figure 1:
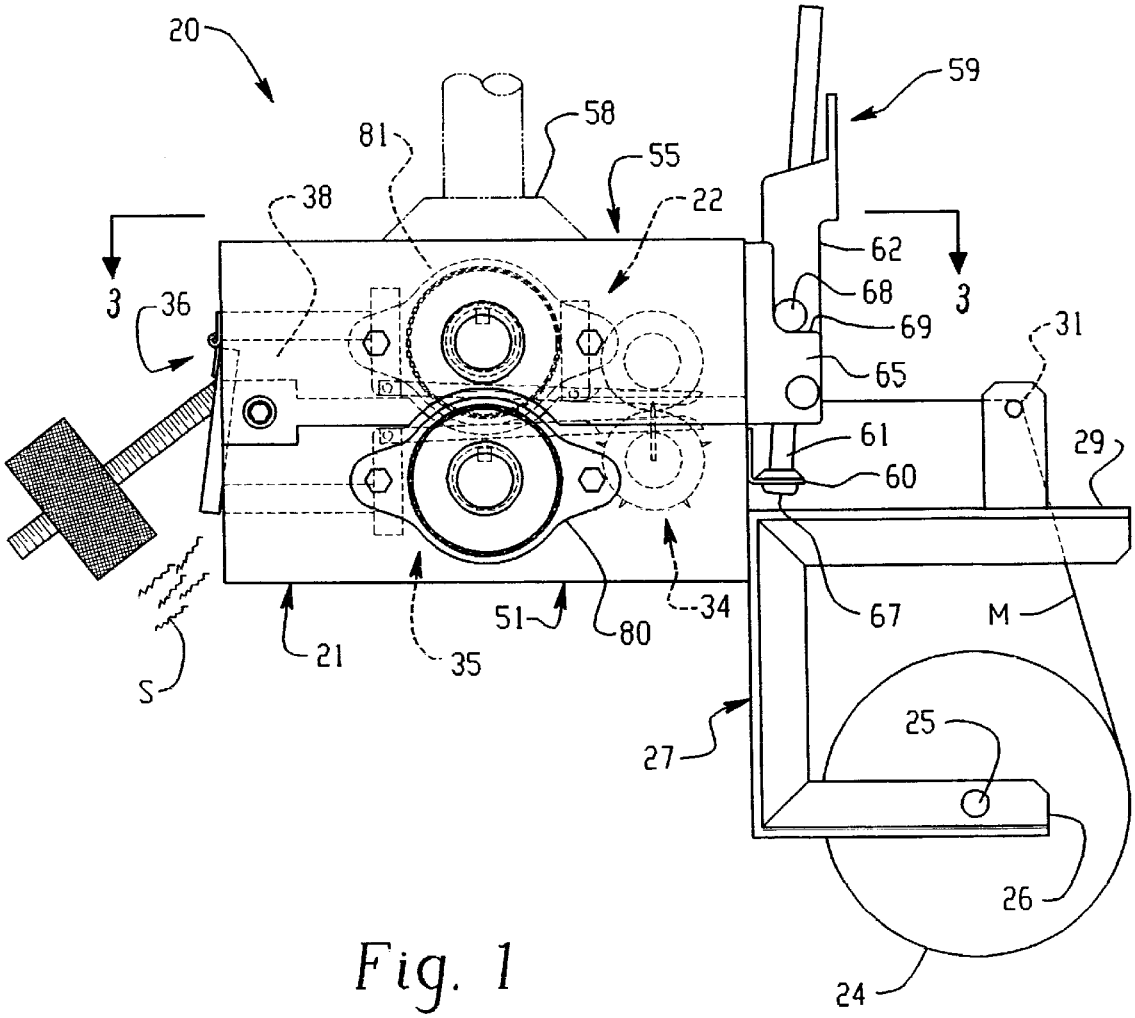
FIG. 1 is a side elevational view of a conversion machine according of the present invention.

Referring now to the drawings in detail, and initially to FIG. 1, a conversion machine according to a preferred embodiment of the invention is designated generally by reference numeral 20. The machine 20 generally comprises a housing 21 containing various conversion components 22 that function to convert sheet stock material M into a plurality of accordion-folded strips S having predetermined unfolded lengths. The sheet stock material is preferably biodegradable, recyclable, and composed of a renewable resource. A preferred sheet stock material is paper, and particularly Kraft paper. The sheet stock material may be composed of one or more plies and particularly one, two or three plies.

As will be appreciated, the hereinafter described features of the invention lend themselves particularly to the provision of relatively compact, lightweight and low cost machine which can be economically used to produce essentially the same folded strips as the above-mentioned earlier machines, especially by the end user of the strips at the user's site. In addition, the various features of the present invention may be individually or collectively used in conversion machines of various types, including the above-mentioned earlier machines.

In addition, the illustrated machine 20 is shown in a preferred orientation, although other orientations are possible with, and contemplated by, the present invention. Consequently, the references to top and bottom, upper and lower, etc. are made in relation to an illustrated orientation of the machine to describe positional relationships between components of the machine and not by way of limitation, unless so indicated. In addition, the references herein to downstream and upstream are made in relation to the movement direction of the stock material M through the machine. The present invention also embodies the various combinations of any one feature of the invention with one or more other features of the invention, even though shown and/or described in relation to separate embodiments.

The sheet stock material M may be supplied in any suitable form, such as in the form of a stock roll 24. The stock roll 24 may be supported by any suitable means, such as on a cart, table or other support. In the illustrated embodiment, the stock roll is supported by an axle 25 between the lower legs 26 of transversely spaced-apart U-shape brackets 27 mounted to a back end of the housing 21. The upper legs 29 of the brackets 27 have mounted therebetween a constant entry roller 31 for directing the sheet stock material into the housing from a constant position.

The aforesaid conversion components 22 generally comprise a transverse severing assembly 34, a longitudinal severing assembly 35, and a folding device 36. Going from right to left in FIG. 1, the sheet stock material M passes from the constant entry roller 31 to the transverse severing assembly 34 where the material is transversely severed, for example by cutting, to define longitudinally extending sections of the stock material. The transversely severed stock material then passes to the longitudinal severing assembly 35 where it severed, for example by cutting or slitting, to form strips. The strips, which preferably have a width many or at least several times smaller than their unfolded length, are separated from the trailing stock material and fed into a discharge chute 38 provided in the folding device 36. Under normal operating conditions, the discharge chute 38 will be full of previously formed and folded strips which form a mass of strips whose movement through the chute is restrained. The mass of strips in essence forms a moving dam against which the newly formed strips are forced by the longitudinal severing assembly such that the strips are caused to fold back and forth into a zig-zag or accordion-like pattern.

The discharge chute 38, which is hereinafter described in greater detail, represents a preferred form of folding device 36. However, it will be appreciated that other folding devices may be used to effect back and forth folding of the longitudinally and transversely separated strips passing from the longitudinal severing assembly 35. For example, the folding device may include cooperating embossing rollers which crimp the strips into their back and forth folded configuration. This arrangement, however, is less preferred as it adds to the cost and complexity of the overall machine.

Figure 3A:
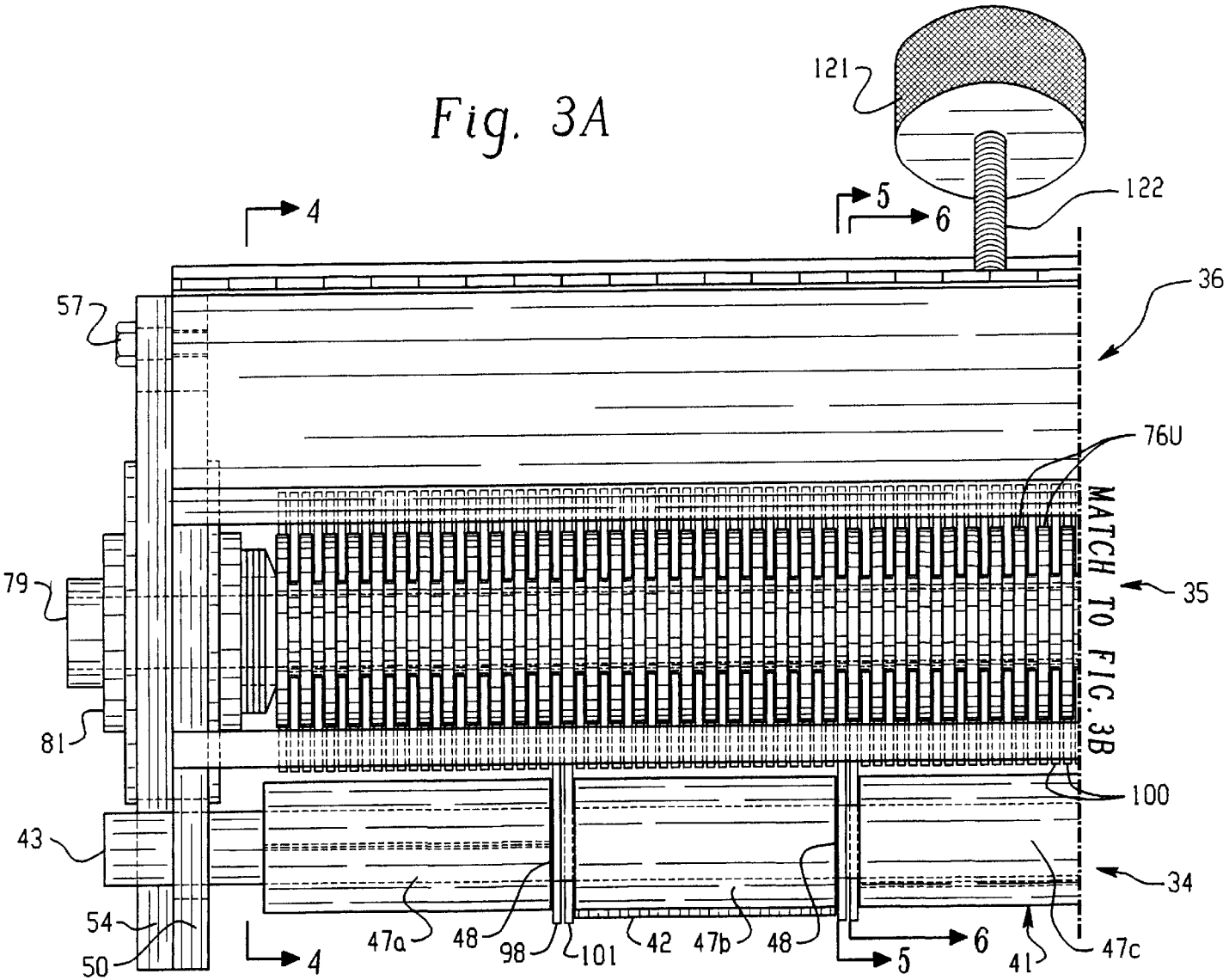
FIGS. 3A and 3B are broken continuations of a top plan view of the conversion machine with the top wall of the upper housing removed to illustrate internal components of the machine.
Figure 3B:
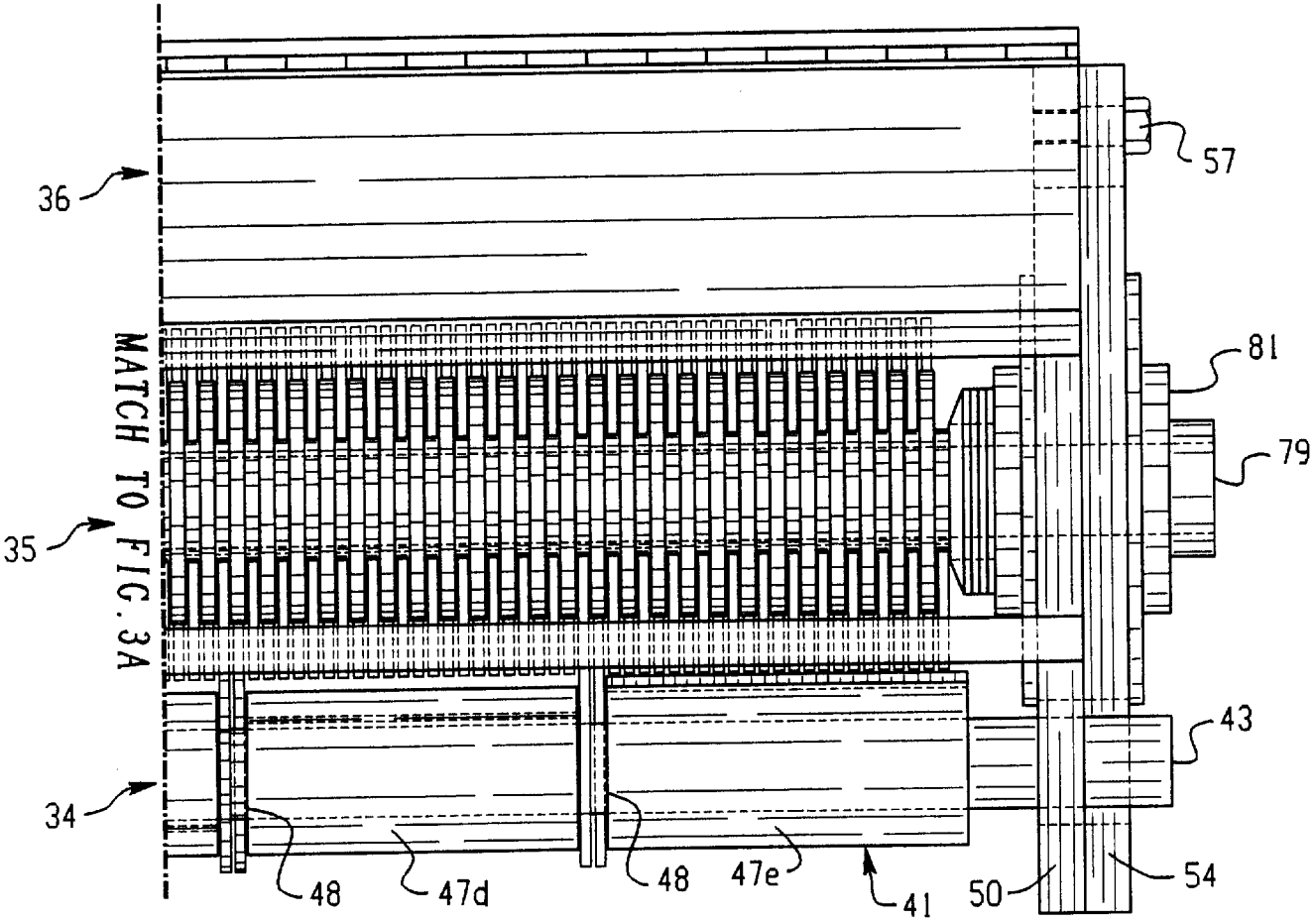
Figure 4:
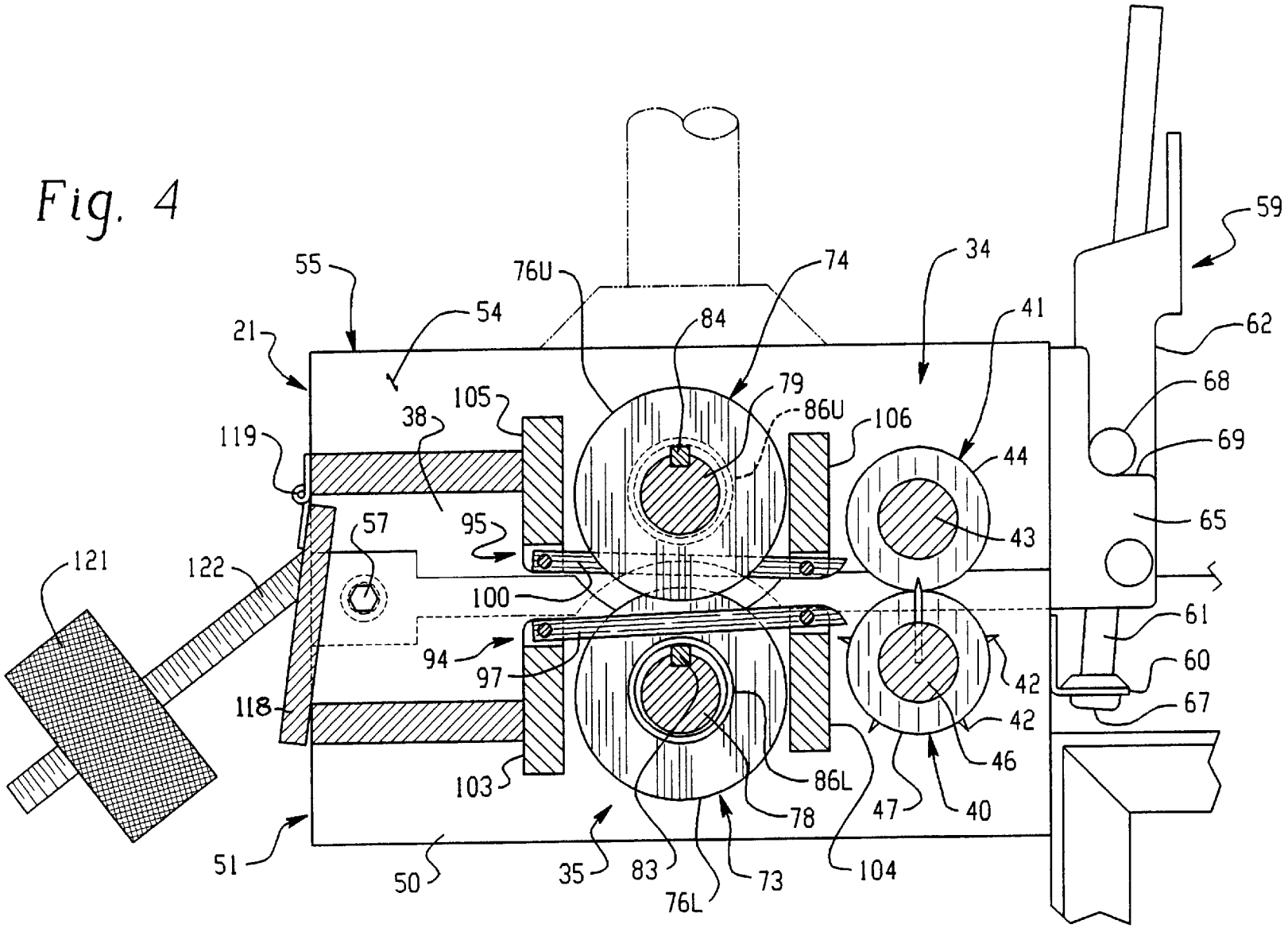
FIG. 4 is a cross-sectional view of the conversion machine taken along the line 4—4 of FIG. 3A.

In the illustrated preferred embodiment, and with particular reference to FIGS. 3A, 3B and 4, the transverse severing assembly 34, also herein referred to as the transverse cutting assembly, comprises a pair of cooperating cuffing elements preferably in the form of rollers 40 and 41. As is preferred, the roller 40, herein termed the cuffing roller, includes a plurality of transversely extending cutting blades 42, while the other roller 41, herein termed the backing roller, functions as a backing for the sheet material as the cutting blades cut through and form transverse slits in the stock material. The backing roller 41 has a center shaft 43 covered by an outer cover 44 having a length equal or greater than the width of the sheet material M (FIG. 1) to be converted. The outer cover 44 is made of a tough resilient material which also preferably has a relatively high coefficient of friction in relation to the stock material. Exemplary and preferred materials include rubber or rubber-like materials such as urethane.

The cutting roller 40 also has a center shaft 46 covered by an outer cover 47 made of the same or similar material. The outer cover 47 is divided along the length thereof (transverse to the movement path of the sheet material through the machine) into several sections 47*a*–47*e* (FIGS. 3A and 3B) that are separated by annular grooves 48 which preferably extend only partway through the thickness of the outer cover if a unitary outer cover is desired for ease of assembly. Each section of the outer cover 47 of the cutting roller corresponds in length to the length of a corresponding cutting blade 42 and has therein a through slot for passage of the blade from the shaft, to which it is attached (preferably removably by suitable means for blade replacement and/or sharpening), through and radially outwardly beyond the outer cover 47. As is preferred, the blades 42 and corresponding slots in the cover 47 are circumferentially staggered with respect to the immediately adjacent blades and corresponding slots. Most preferably, the blades are uniformly circumferentially staggered around the circumference of the cutting roller 40. This provides for more uniform power distribution and enables the use of a unitary cover. By way of specific example, the illustrated machine 20 has five cutting blades circumferentially staggered at 720 increments. Accordingly, a section of the sheet material is transversely slit every one-fifth revolution of the cutting roller.

The cutting roller (lower) shaft 46 is supported, via suitable bearings at opposite ends thereof, by respective side plates (walls) 50 of a lower section 51 of the housing 21. Similarly, the backing roller (upper) shaft 43 is supported, via suitable bearings at opposite ends thereof, by respective side plates (walls) 54 of an upper section 55 of the housing. The provision of lower and upper housing sections 51 and 55 is advantageous as they may be configured to be separable to facilitate initial loading, clearing, maintaining and/or repairing of the machine. This separation of the housing sections, which carry cooperating mating components of the machine, such as the above-described cutting and backing rollers 40 and 41, enables convenient access to most of the internal components of the machine.

Figure 2:
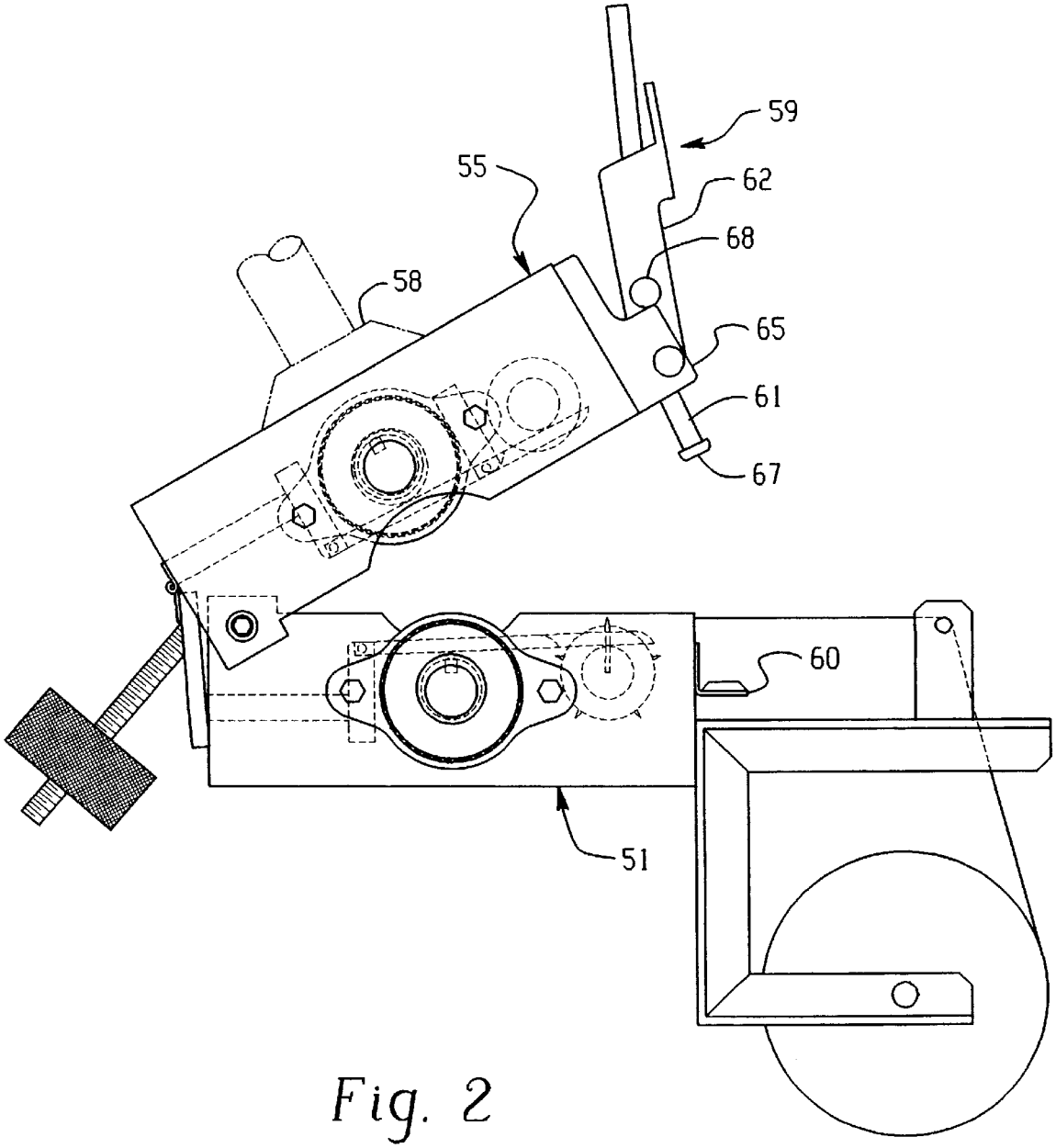
FIG. 2 is a side elevational view of the conversion machine shown in FIG. 1, with the upper section of the machine's housing shown in an open position.

The housing sections 51 and 55 may be connected together by any suitable means, although preferably in a manner that enables relatively quick and easy separation of the housing sections. In the illustrated embodiment, the housing sections have overlapping portions of the side plates 50 and 54 thereof hingedly connected together by pivots 57 in a clamshell fashion. FIG. 1 shows the housing sections closed and FIG. 2 shows the housing sections open. Preferably, when the housing sections are closed, together they surround a substantially enclosed space or chamber containing the transverse and longitudinal severing assemblies 34 and 35. This space is advantageously connected with an exhaust port 58 which may be connected to a vacuum for withdrawing and/or collecting paper particles. The exhaust port also functions to withdraw heat from the interior of the housing sections 51 and 55, air being drawn over the interior components and particularly the slitters 73 and 74 for cooling them and then the heated air passing out of the housing through the exhaust port.

The housing sections 51 and 55 are preferably held together by a quick release latching mechanism such as the illustrated overcenter quick release latching and clamping assembly 59 shown in FIGS. 1, 2 and 4. The latching and clamping assembly 59 includes a catch 60 on one of the housing sections, i.e., the lower housing section 51, and a latching pin 61 pivotally attached to a latching arm 62. The latching arm 62 is pivotally connected to a bracket 65 on the front side of the upper housing section 55.

When the latching and clamping assembly 59 is disengaged as shown in FIG. 2, the upper housing section 55 can be lowered against the lower housing section 51. With the latching arm 62 swung outwardly to its disengaged position shown in FIG. 2, the lower end of the latching pin 61 is in a lower condition allowing the head 67 at the lower end thereof to be positioned beneath the catch 60. Then, to lock the upper and lower housing sections together, the latching arm 62 is swung inwardly toward its engaged position shown in FIG. 1. As the latching arm is swung inwardly, a cam pin 68 thereon will engage and slide on a cam surface 69 on the bracket 65, urging the upper and lower sections together, until the cam pin reaches an overcenter position locking the latching arm in position as shown in FIGS. 1 and 4. In reverse manner, the latching arm may be swung outwardly to release the latching pin which can then be moved clear of the catch to permit full opening of the upper housing section relative to the lower housing section.

When the latching arm 62 is moved into the overcenter position, the lower and upper housing sections 51 and 55 will be held together with the covers 47 and 44 of the cutting and backing rollers 40 and 41 pressed against one another to form a nip for feeding the sheet material between the rollers and to the longitudinal cutting assembly 35. Preferably, provision is made for adjusting the pinch force at the nip between the cutting and backing rollers for use with different stock materials which may vary in thickness, stiffness, number of plies, etc. For example, the latching pin 61 may be telescopically adjustable in the latching arm 62 to change the effective length thereof for a corresponding change in the pinch force between the cutting and backing rollers. In another arrangement, the latching pin 61 may be resiliently biased to resiliently hold together the cutting and backing rollers 40 and 41 under a desired preload. Looking at FIG. 4, the spring force will act to urge the lower and upper housing sections 51 and 55 together when the latching arm 62 has been moved to its engaged or latched position shown in FIG. 4.

The cutting and backing rollers 40 and 41 may be rotatably driven by any suitable means. For example, the cutting roller 40 or lower shaft 46 and the backing roller 41 or upper shaft 43 may have mounted on the ends thereof gears, sprockets or the like which are powered by a motive means such as an electric motor via other gears, sprockets and/or chains, and the like. The same, similar or other power train may be used to drive lower and upper slitting members or slitters 73 and 74 of the longitudinal slitting assembly 35.

The lower and upper slitters 73 and 74 are respectively composed of a plurality of cutting or slitting discs 76L and 76U which are interleaved with the slitting discs of the other slitter at overlapped portions thereof. In the illustrated embodiment, the slitting discs 76L and 76U of the lower and upper slitters 73 and 74 are mounted on respective shafts 78 and 79 that extend between the housing side walls 50 and 54 and are rotatably supported at their ends by bearings 80 and 81 secured to the housing side walls (FIGS. 1, 3A and 3B). The slitting discs 76L and 76U are coupled to the respective shaft 78 and 79 for rotation therewith by a key or spline 83 and 84. The slitting discs 76L and 76U on each shaft 78 and 79 are transversely spaced apart by spacers 86L and 86U. Preferably, the spacers are in the form of circular rings that have a inside diameter great enough to slip over the shaft key or spline (the spacer rings are thus disposed "off center" or eccentric on the shafts). Accordingly, the spacers can be easily and inexpensively formed by cutting spacer rings from tubing. The spacers or spacer rings preferably have a thickness slightly greater than the thickness of the corresponding slitting disk of the opposing slitter. This defines an annular space having a thickness slightly greater than the thickness of the cutting blade which extends into such space at the point of overlap between the lower and upper slitters, thereby to minimize friction between the overlapping slitting disks while still positioning the overlapping slitting disks sufficiently close together to effect longitudinal slitting of the sheet material as it passes between the slitters. As will be appreciated, the interleaved slitting disks cooperate to effect a sheering of the sheet material along longitudinally extending cut lines defining the width of the strips being formed. As will also be appreciated, the slitting disks need not all be of the same thickness. Rather, slitting disks of different thicknesses may be used to simultaneously produce strips of corresponding different thicknesses. Accordingly, different thickness spacer rings would be provided to define the spaces between the slitting disks of one slitter for receiving the corresponding overlapping portions of the slitting disks of the other slitter.

Figure 7A:
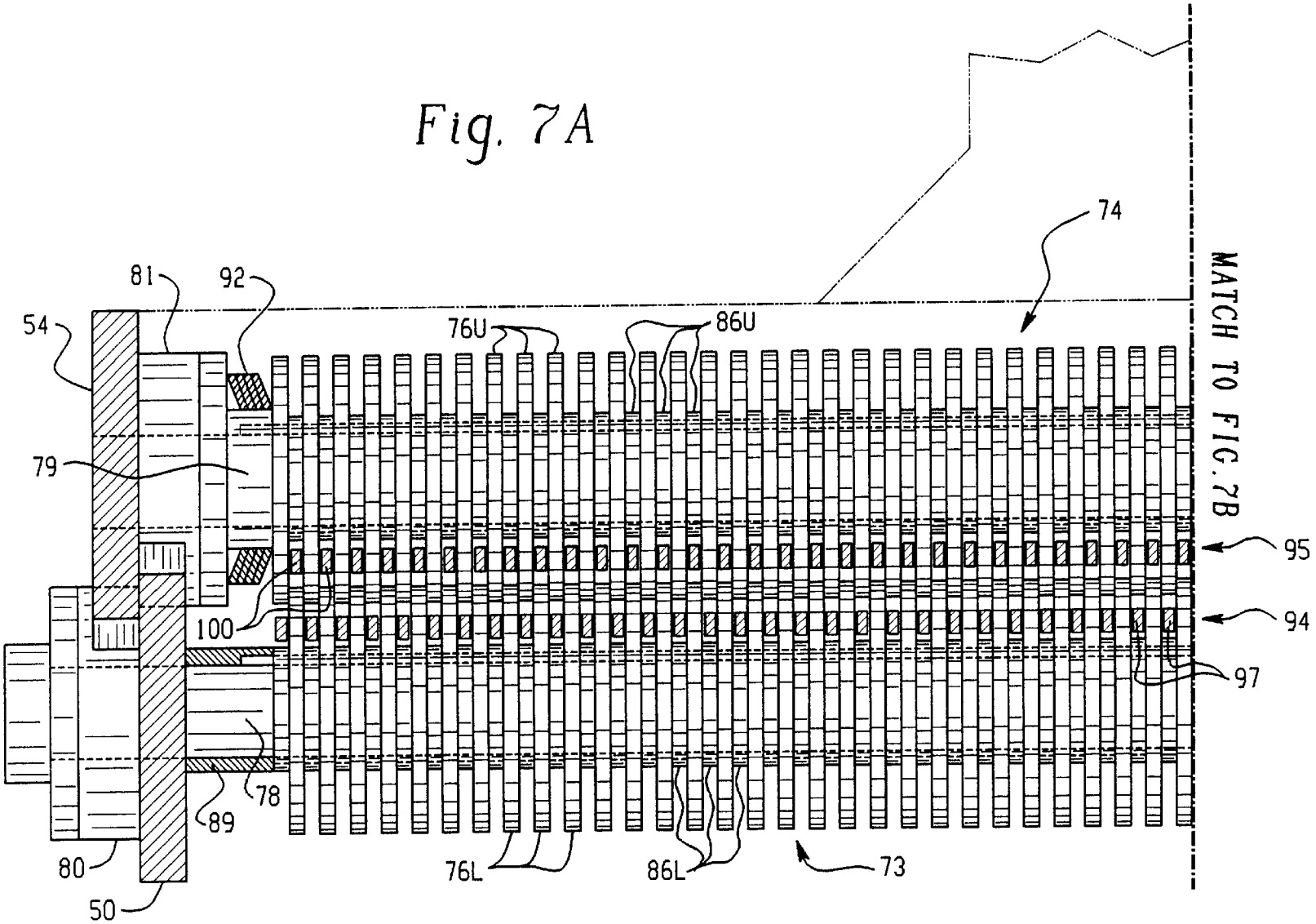
FIGS. 7A and 7B are broken continuations of a cross-sectional view of the conversion machine taken along the line 7—7 of FIG. 6.
Figure 7B:
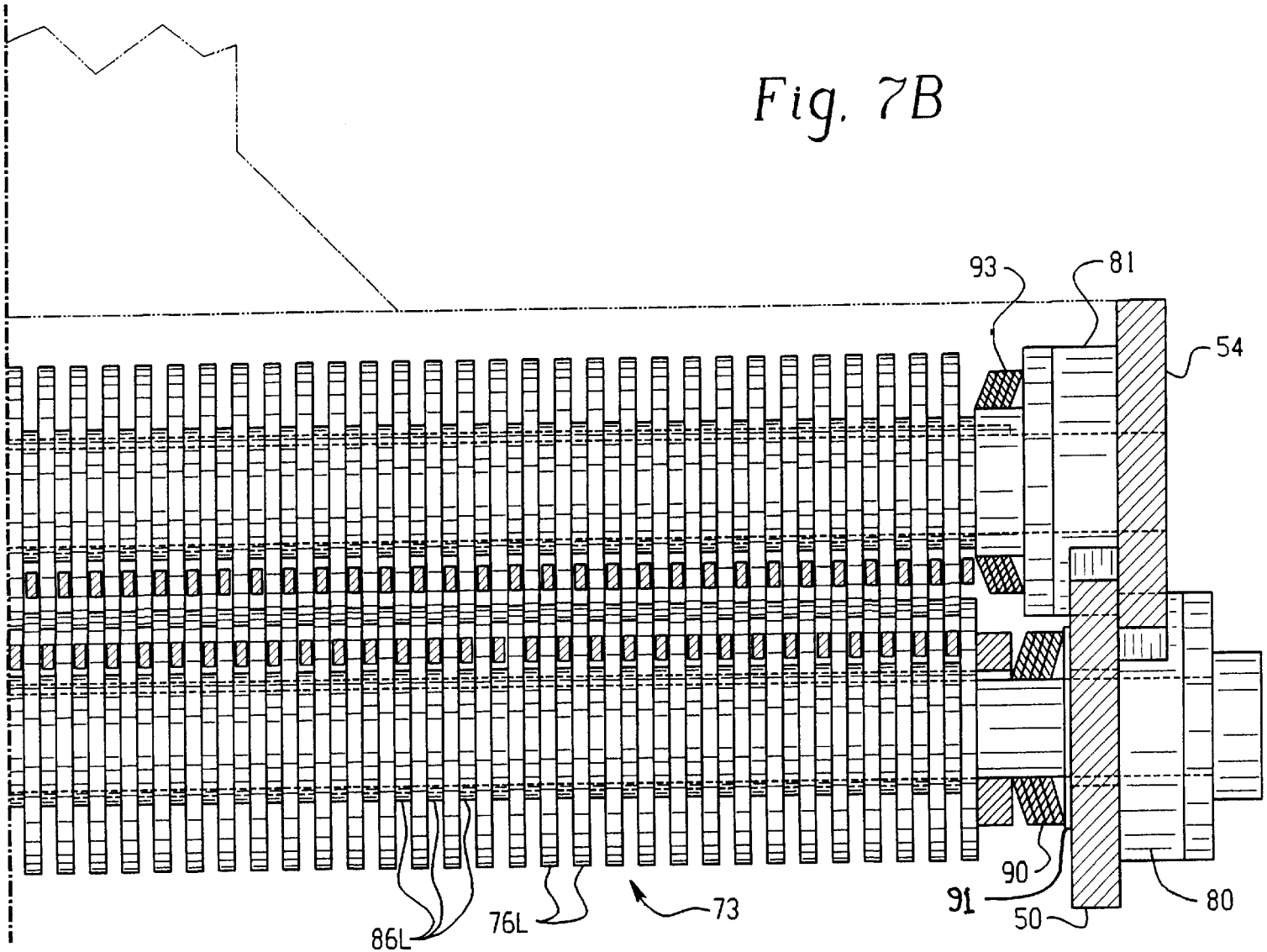

With particular reference to FIGS. 7A and 7B, the spacers 86L and 86U and slitting discs 76L and 76U preferably are slipped onto the respective shaft 78 and 79 and assembled together as a stack or array consisting of alternating spacers and slitting discs. Also, the spacers and slitting discs preferably are transversely movable on the shaft, as by sliding, to permit limited self alignment of the slitting discs in the spaces between the relatively adjacent slitting discs of the other slitting member. At the end of one shaft, i.e., the lower shaft 78, there is provided a fixed stop 89 against which the stack of spacers and slitting discs are resiliently held. In the illustrated embodiment the stop is formed by a stop collar against which one end of the stack of spacers and slitting discs is held by a resilient means or other suitable biasing device 90 provided at the opposite end of the stack. As shown, the resilient means may include one or more Belleville washers disposed between the end of the stack of spacers and slitting discs and an abutment such as a spacer 91 having a collar portion interposed between the Belleville washers and the adjacent lower housing plate 50 as shown in FIG. 7B. Unlike the lower slitter, the stack of spacers and slitting discs forming the upper slitter have a resilient means 92 and 93 or other suitable biasing device disposed at both ends thereof. Again, the resilient means may include one or more Belleville washers as shown.

With the foregoing arrangement, the stop 89 functions as a positive locating device towards which the spacers 86L and slitting discs 76L of the lower slitter 73 are resiliently urged by the Belleville washers 90. The slitting discs 76L may separate slightly as needed to accommodate misaligned upper slitting discs 76U which are also free to shift axially on the upper shaft 79. Also, the entire upper array of spacers 86U and slitting discs 76U, as well as each individual spacer and slitting disc, can shift slightly axially on the upper shaft 79 for self-alignment of the slitting discs with respective spaces between the slitting discs of the other slitter. This arrangement advantageously allows for a larger acceptable range of tolerances and also prevents excessive contact loading and thus assists in reducing heat generated by frictional contact between the overlapped slitting discs, while providing for optimal longitudinal slitting of the stock material. As a result, a motor can be used that is of substantially lower horsepower, and thus cost, than the motors previously used to power the prior art conversion machines referred to in the background.

As particularly shown in FIGS. 3A, 3B, 4, 5, 6, 7A and 7B, lower and upper arrays 94 and 95 of guide elements 97, 98 and 100, 101 are provided to guide the sheet material through the transverse cutting assembly 34 and longitudinal slitting assembly 35. The guide elements are elongated bar-like or rod-like members herein referred to as combers as they also function to prevent the stock material from moving around the slitters as they rotate. The guide elements 97 and 98 of the lower array 94 preferably are supported in a common plane by lower transverse rails 103 and 104 and the guide elements 100 and 101 of the upper array 95 are supported by upper transverse rails 105 and 106. The upper and lower rails, which are supported between the side plates of the respective housing sections, have at the inner edges thereof a plurality of ribs forming therebetween slots for receiving respective combers. The ribs and combers have therein transversely aligned openings through which support rods 110 pass to hold the combers to the support rails.

The lower array 94 of guide elements include shorter combers 97 and a lesser number of longer combers 98. The shorter and longer combers are slightly narrower than and respectively pass through the annular spaces between the lower slitting discs 76L at a chordal line slightly outwardly spaced from the upper slitting disc 76U extending into the same space. More particularly, the combers are thinner than the spacers to minimize friction between the combers and the rotating slitting discs. The longer combers 98 also pass through respective ones of the annular grooves 48 in the cutter roller 40 and terminate upstream of the cutter roller. Similarly, the upper array 95 of guide elements include shorter combers 100 and a lesser number of longer combers 101. The shorter and longer combers are slightly narrower than and respectively pass through the annular spaces between the upper slitting discs 76U at a chordal line slightly outwardly spaced from the lower slitting disc 76L extending into the same space. The longer combers 101 also pass through respective ones of the annular grooves 48 in the backing roller 41 and terminate upstream of the backing roller.

The planes of upper and lower arrays of combers are generally parallel and closely spaced to define a narrow passageway for the sheet material. Most preferably, the planes of the upper and lower arrays slightly diverge going along the path of the sheet material to accommodate the increased volume of the folded strips relative to the flat sheet stock material that enters the machine at the upstream end thereof. At their downstream ends, the combers terminate at the inlet opening of the discharge chute 38. In the illustrated embodiment the inlet opening is formed between the proximal edges of the downstream lower and upper transverse rails 103 and 105. The discharge chute is further defined between the side plates of the lower and upper housing sections, a top wall or plate 115 extending between the side plates 54 of the upper housing section and a bottom wall or plate 116 extending between the side plates 50 of the lower housing section.

Figure 5:
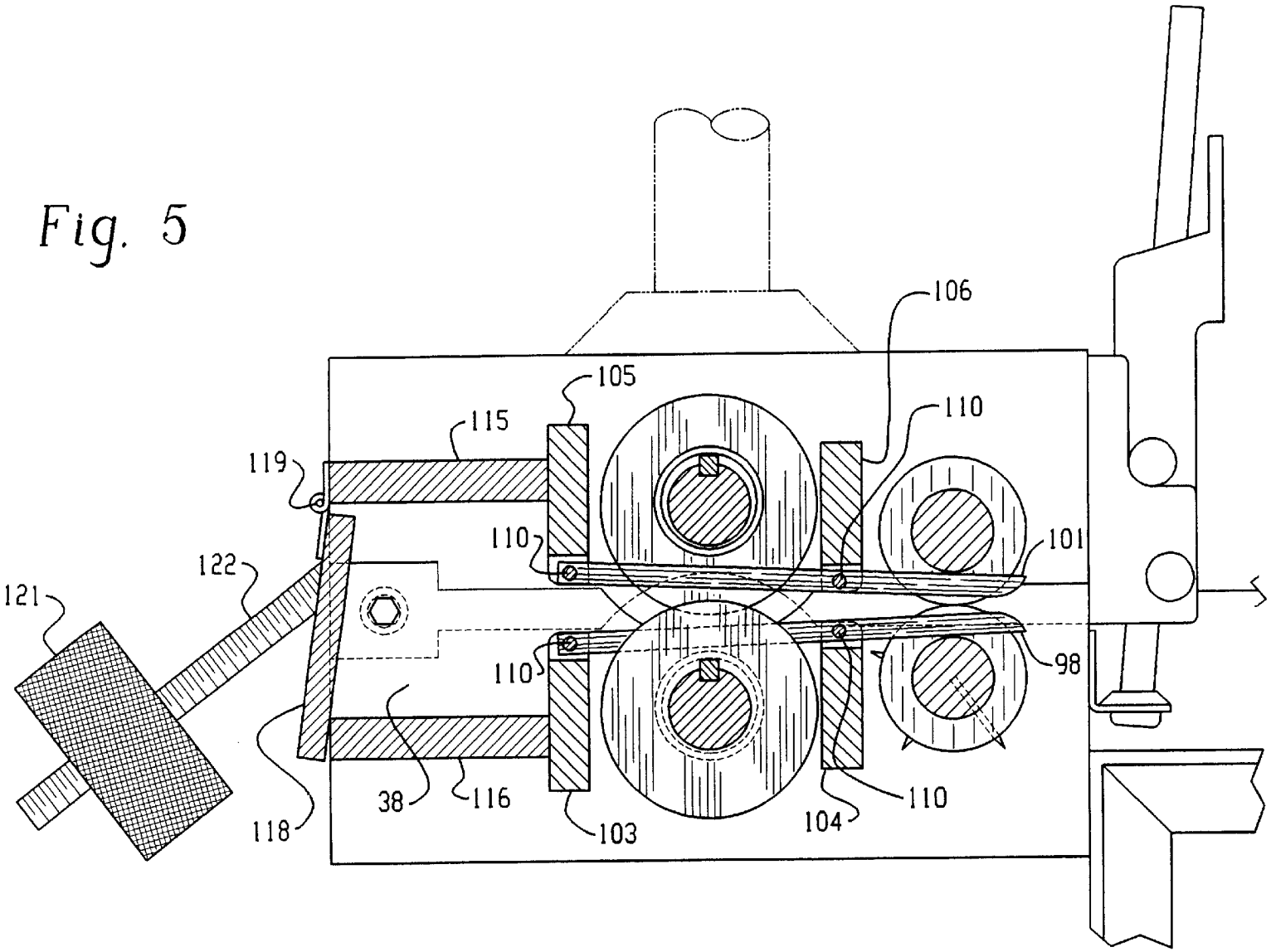
FIG. 5 is a cross-sectional view of the conversion machine taken along the line 5—5 of FIG. 3A.
Figure 6:
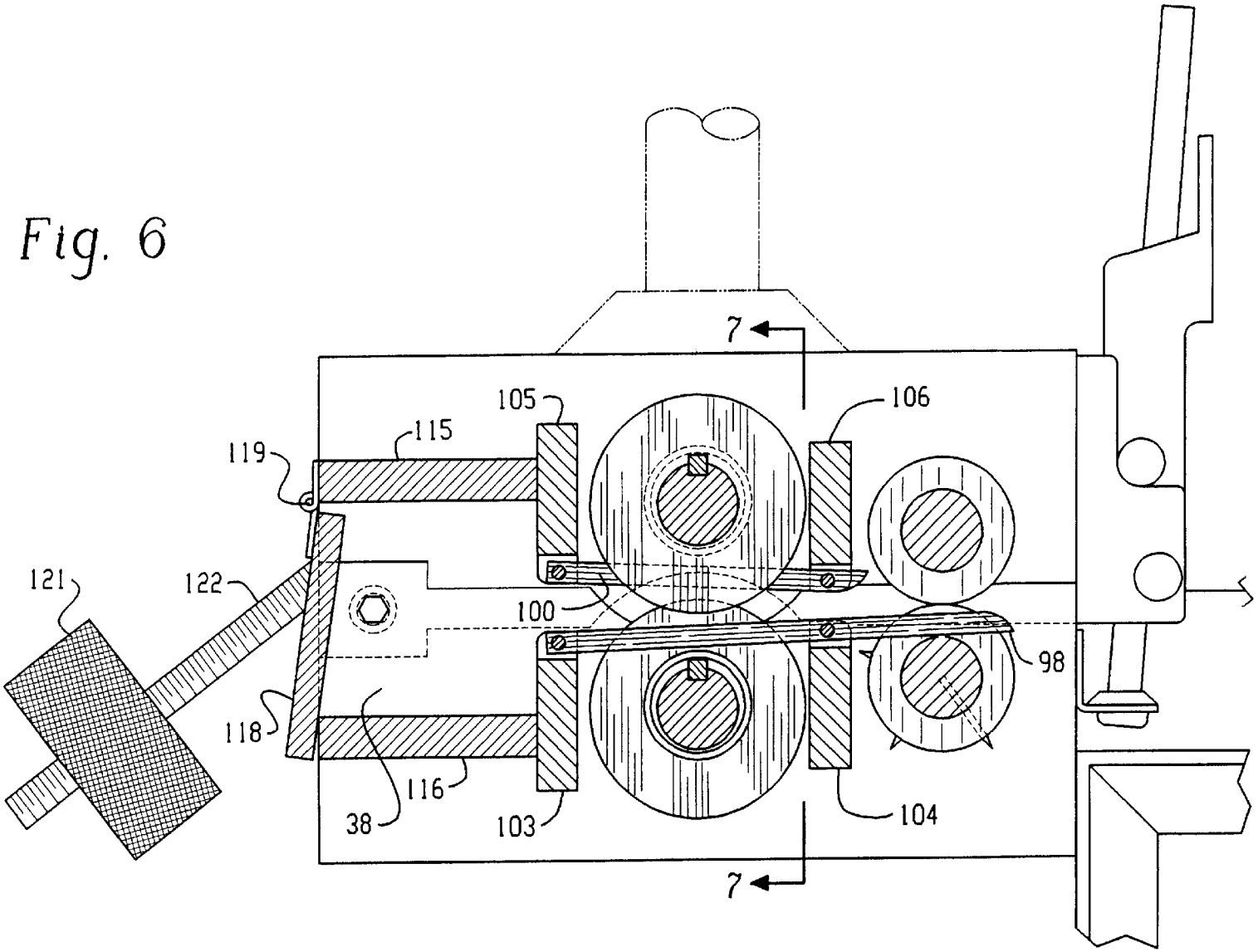
FIG. 6 is a cross-sectional view of the conversion machine taken along the line 6—6 of FIG. 3A.

As shown in FIGS. 4–6, the downstream end of the chamber 38 is closed by a movable barrier or gate 118. In the illustrated preferred embodiment the gate is pivotally connected to the top plate 115 by a hinge or hinges 119 and is normally biased closed by suitable biasing means. In the illustrated embodiment, the biasing means is a weight 121 and relies on gravity to bias the gate to its closed position illustrated in FIGS. 4–6. The weight is threaded on a threaded support rod 122 attached to the gate, whereby the gate may be adjustably positioned along the length of the support rod to vary the moment arm of the weight and thereby vary the biasing force acting on the gate. It will be appreciated that other biasing means may be employed with desirable results, such as a spring or springs provided to resiliently bias the gate to its closed position.

In operation, sheet material is initially fed between the cutting and backing rollers 40 and 41 which function to draw the sheet material from the supply thereof and then transversely cut the sheet material to form transverse slits therein. The circumferential spacing of the transverse cutting blades 42 results in transverse slits that partially extend across the width of the sheet material, making staggered slit material. The transversely cut sheet material is then guided by the comber arrays 94 and 95 to the longitudinal severing assembly 35 wherein the longitudinal separation of the sheet is performed by longitudinally slitting the sheet material to form at least one and preferably a plurality of strips. The strips are then advanced into the folding device 36 wherein they are folded into the desired accordion shape.

Although other means may be employed to fold the strips, in the illustrated embodiment the unfolded strips are expelled into the discharge chute wherein previously folded strips accumulate and form a moving dam of strips whereby folding is accomplished in such a manner that the natural resilience of the material produces adjacent opposite folds thereby causing the strips to assume substantially the same accordion or zig-zag shape. A restriction to movement of the strips is formed by the gate at the discharge or outlet end of the chute. As the number of strips increases, the pressure on the barrier 118 eventually overcomes the resistance of the weight 121, the barrier partially opens and the accordion-folded strips exit the machine preferably with the barrier continuing to provide a restriction to free flow of the strips whereby a mass thereof remains in front of the newly formed strips passing from the slitters 73 and 74.

The folding alternatively may be accomplished by positively forming the strips into the desired accordion-folded shape. For example, the folding device could comprise mating rotating members each having a radially outer surface contoured to emboss a zig-zag shape into the strips as they pass thereby.

Figure 8:
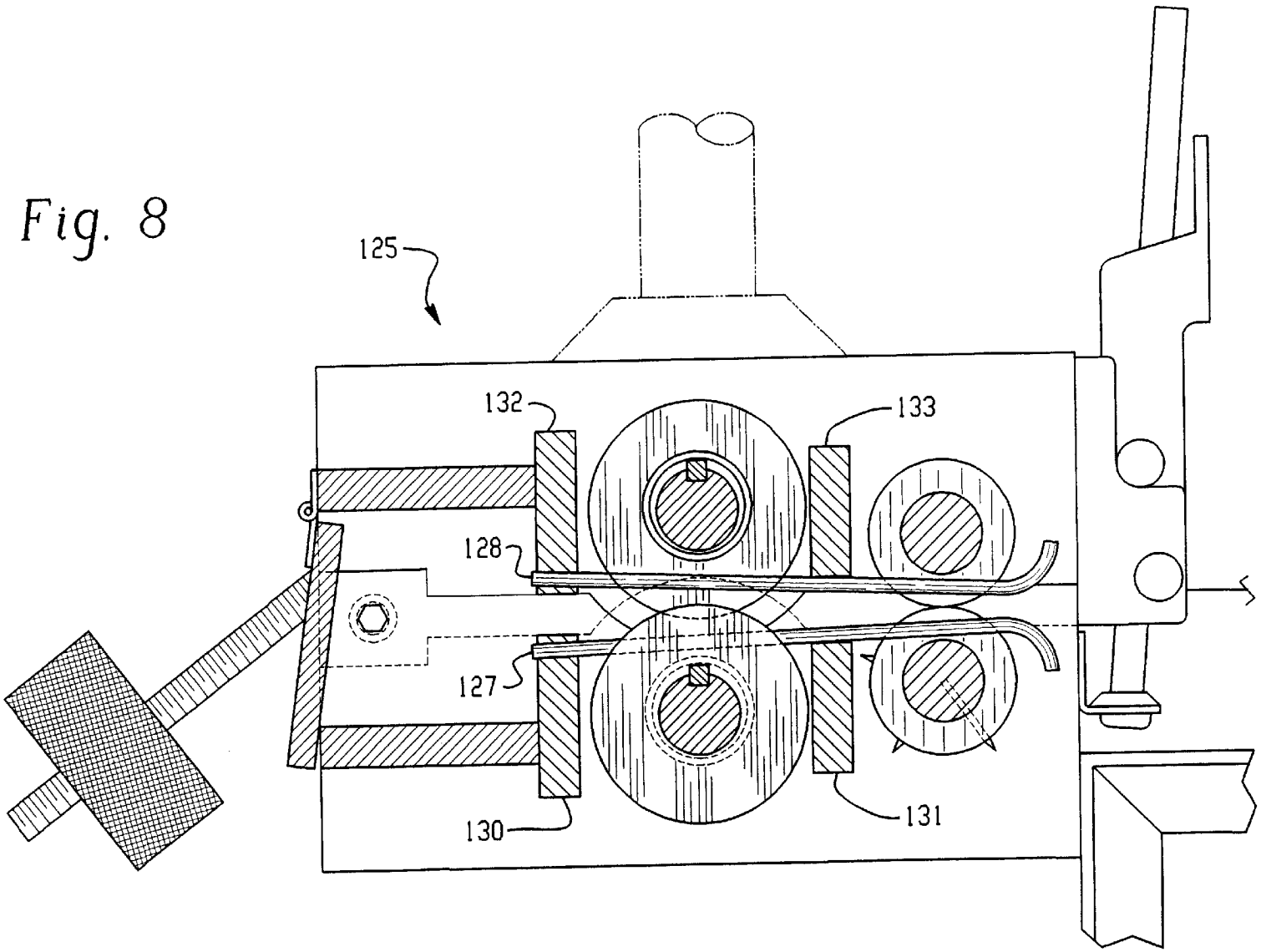
FIG. 8 is a cross-sectional view similar to FIG. 5, but showing an alternative form of combers.

Turning now to FIG. 8, another embodiment of conversion machine is designated generally by reference numeral 125. The machine 125 is identical in construction and operation to the machine 20 of FIG. 1, except that a different form of comber is used. As shown, the combers 127 and 128 are formed from wire, for example hardened piano wire. Preferably, the upstream ends of the upper and lower wire combers 127 and 128 are turned outwardly to form a flared mouth for the sheet material. The combers 127 and 128 are secured by suitable means to the transversely extending support rails 130–133. For example, the wire combers may extend through holes in the support rails or may be welded to the support rails. In this embodiment there are longer and shorter combers arranged similarly to those described previously. The shorter combers, which are not shown, preferably are similarly formed from wire bent to a desired configuration corresponding generally to the configuration of the guide surfaces of the above-described combers.

Figure 9:
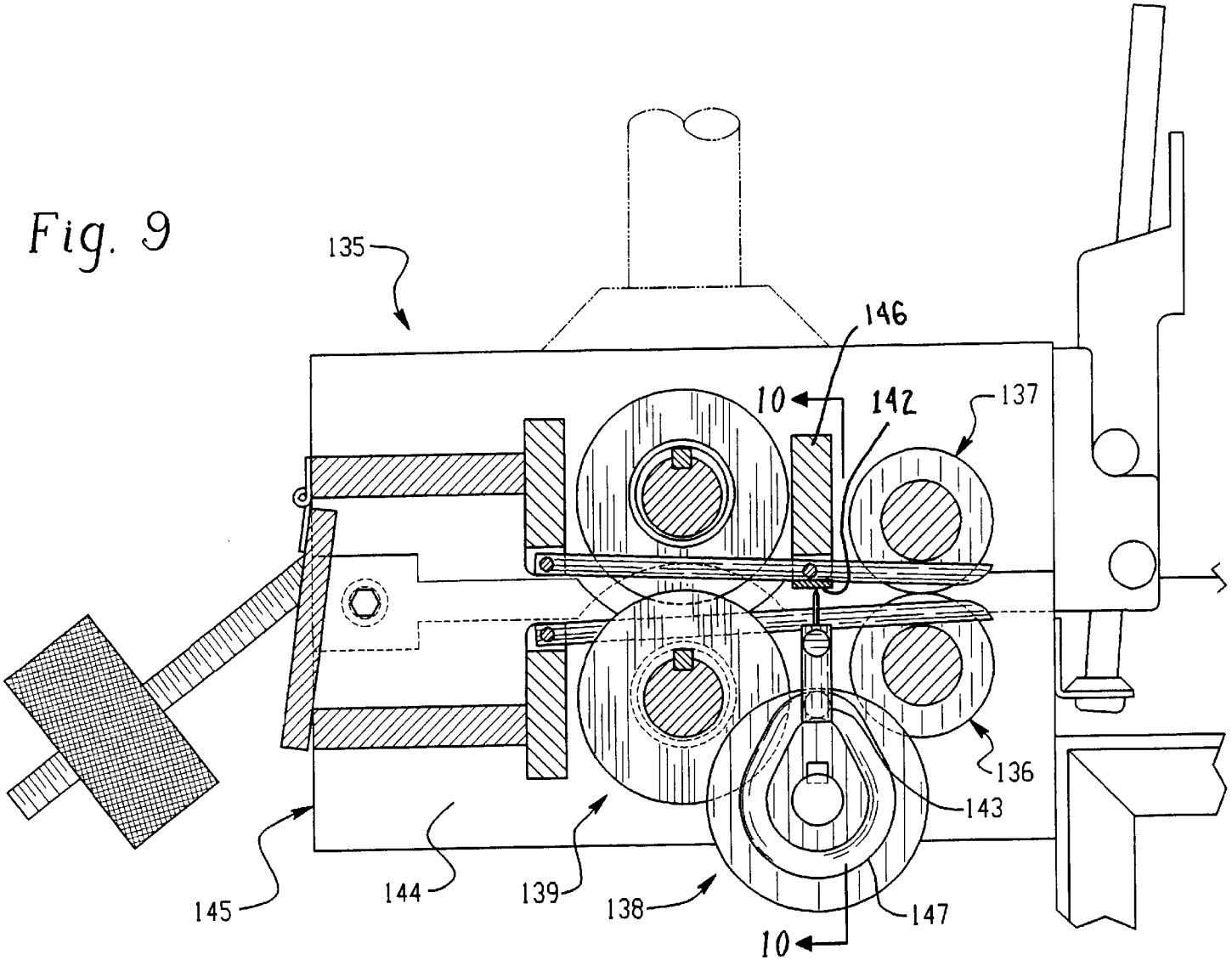
FIG. 9 is a cross-sectional view similar to FIG. 5, but showing an alternative form of transverse severing assembly.
Figure 10:
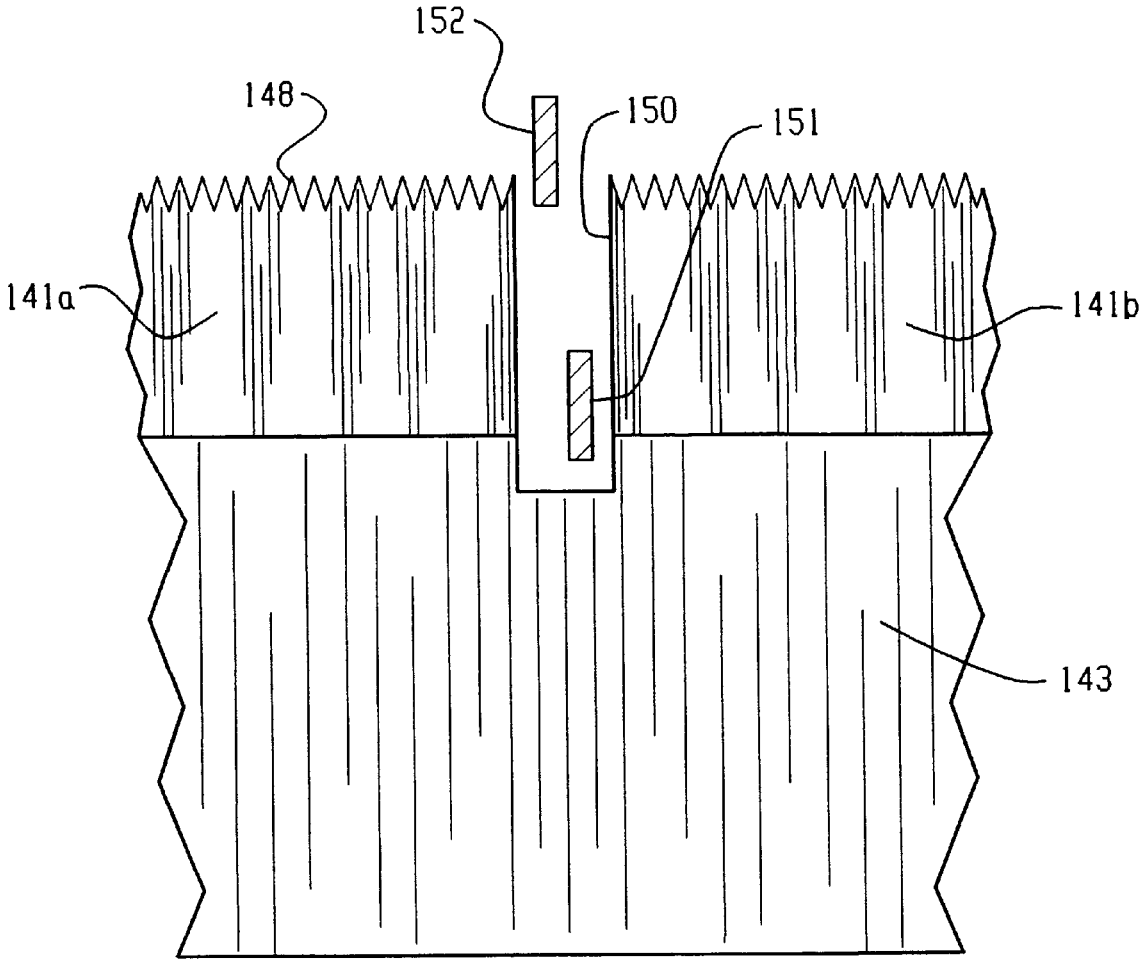
FIG. 10 is a cross-sectional view taken along the line 10—10 of FIG. 9.
Figure 11:
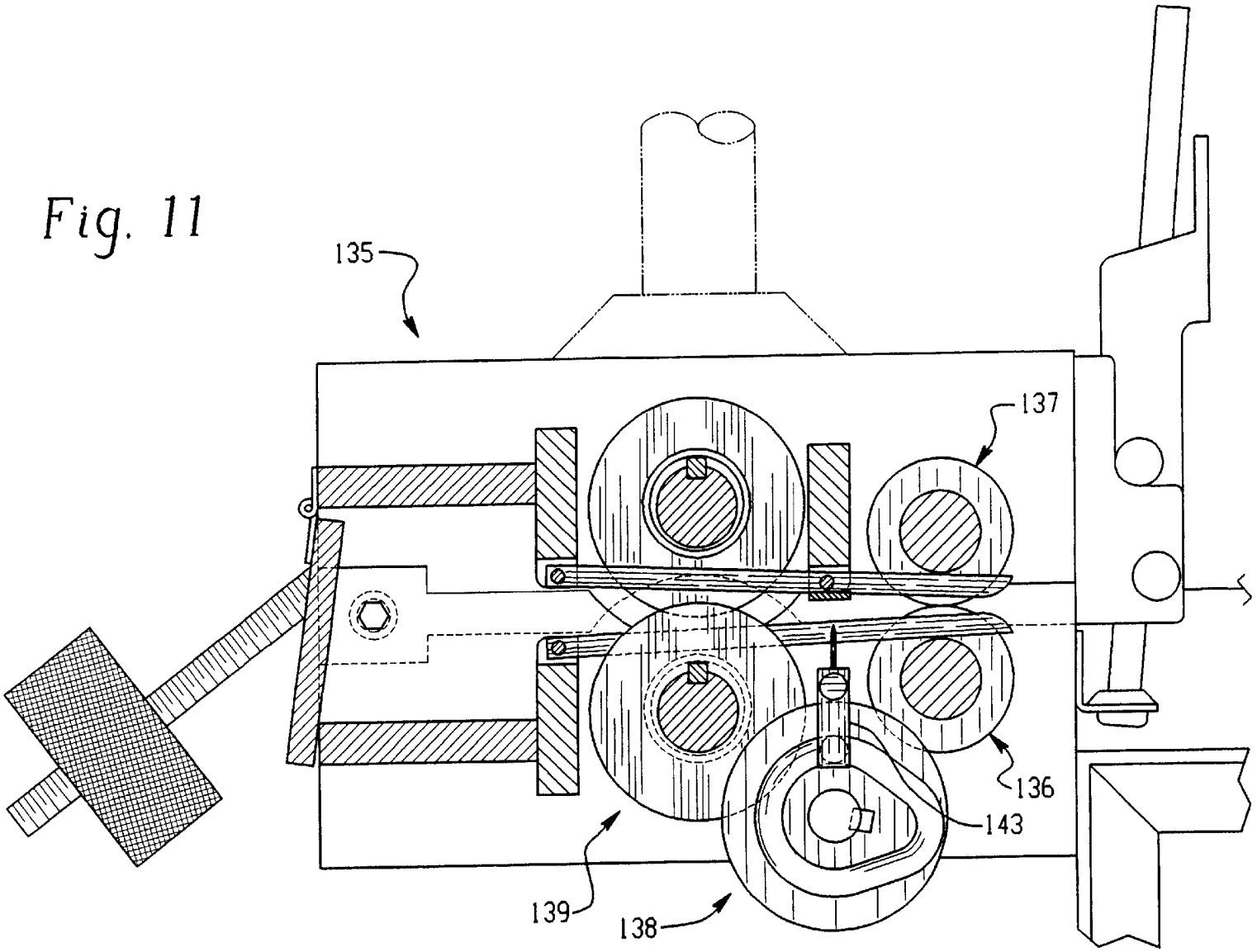
FIG. 11 is a cross-sectional view similar to FIG. 9, but showing a retracted position of the cutting blade used in the transverse severing assembly of FIG. 9.

In FIGS. 9–11, another embodiment of conversion machine according to the invention is designated generally by reference numeral 135. The machine 135 is identical in construction and operation to the machine 20 of FIG. 1, except that the transverse cutting blades are no longer incorporated into the upstream rollers indicated at 136 and 137. Accordingly, the rollers 136 and 137 function as pull/feed rollers, while a separate transverse severing device 138 is provided between the pull/feed rollers and the longitudinal severing assembly 139.

The transverse severing device 138 includes a reciprocating knife or blade 141. The knife is mounted in a holder 143 that is driven up and down between the positions shown in FIGS. 9 and 11 in a plane perpendicular to the plane of the sheet material passing thereby. The blade holder is guided by suitable means for such movement. For example, the ends of the blade holder may be guided in inwardly opening slots in the side plates 144 of the lower housing section 145. Also, the blade holder may be reciprocally driven by any suitable means. In the illustrated embodiment, a rotating cam 147 is used to drive the blade holder, the blade holder operating like a cam follower. Preferably, a backing member 142 is provided for supporting the strip material as the knife cuts therethrough. The backing member 142 may be, for example, a strip of urethane or similar material conveniently attached to the inner ends of the upper transverse rail 146 as shown.

The frequency of the cutting stroke of the knife 141 determines the length of the unfolded strips. The faster the knife is reciprocated relative to the speed of the slitters, the shorter the length of the unfolded strips. Conversely, the slower the knife is reciprocated relative to the speed of the slitters, the longer the length of the unfolded strips. Any suitable means may be employed to vary the cutting frequency relative to the feed rate of the sheet material. In the illustrated embodiment, different gear sets may be used to vary such frequency.

As shown in FIG. 10, the knife 141, which may have a serrated cutting edge 148, is divided into sections 141*a* and 141*b* which are spaced apart to form slots 150 therebetween. The slots permit passage therethrough of the longer lower and upper combers 151 and 152. There are enough sections to extend the width of the sheet material. This particular cutting technique separates an entire leading end portion of the web as compared to the partial transverse cutting that occurs in the above described machine 20.

Figure 12:
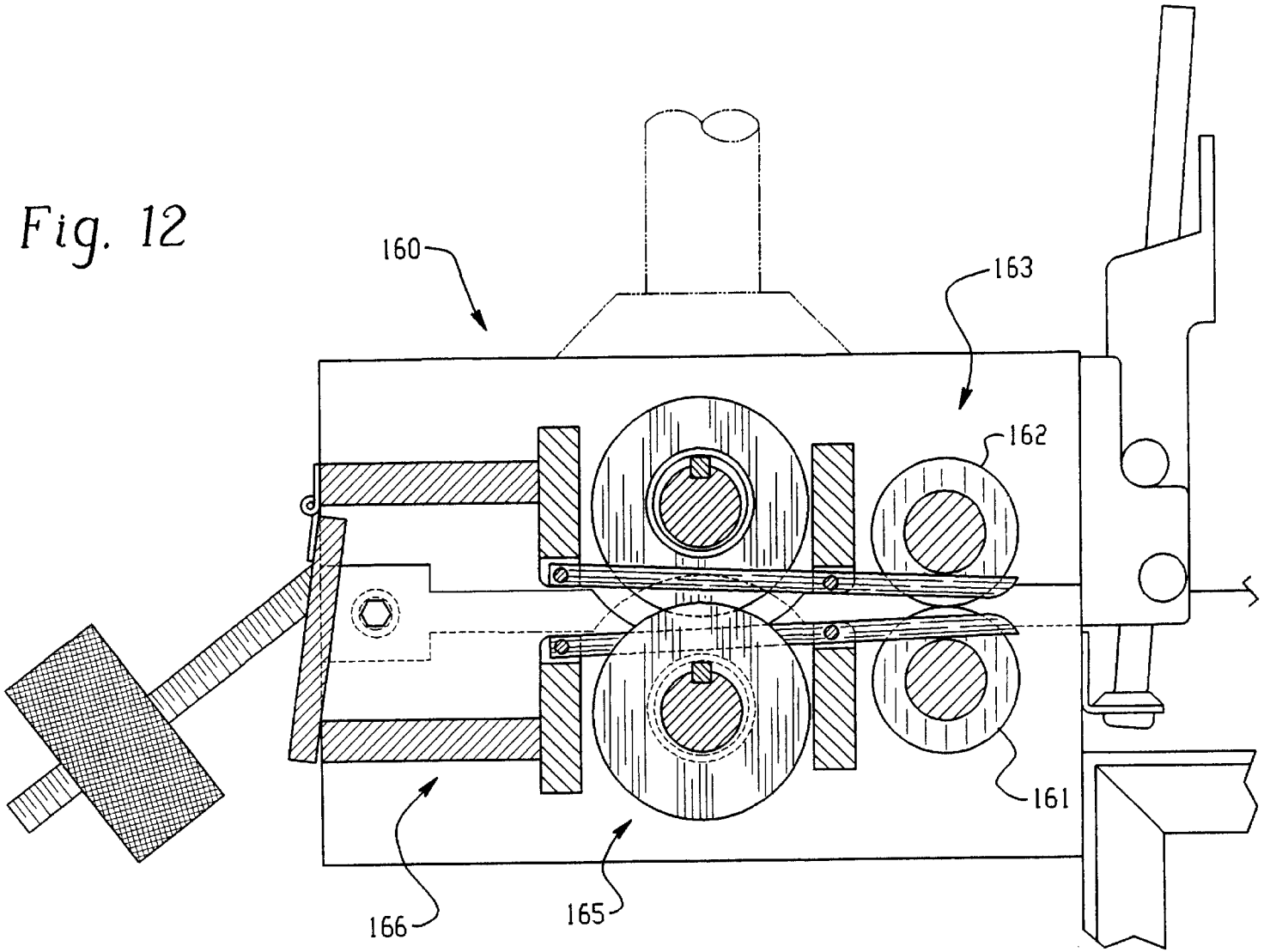
FIG. 12 is a cross-sectional view similar to FIG. 5, but of another embodiment of the invention which uses a pre-severed paper, particularly a staggered pre-cut paper, in place of a transverse severing assembly.

Referring now to FIG. 12, another embodiment of conversion machine according to another aspect of the invention is designated generally by reference numeral 160. The machine 160 is identical in construction and operation to the machine 135 shown in FIGS. 9–11, except that the transverse severing device has been eliminated. Thus, the major components of the machine 160 include the pull/feed rollers 161 and 162 forming a feeding assembly 163, a longitudinal severing assembly 165, and a folding assembly 166. The machine 160 is intended for use with pre-transversely severed sheet material. That is, the sheet stock material is pre-transversely slit (preferably in a staggered pattern) and supplied as in roll form or otherwise for feeding into the machine 160. Then, in the machine 160, the sheet material is longitudinally severed and folded in the above described manner.

The pre-cut sheet material preferably comprises a substantially planar sheet having a plurality of columns of longitudinally aligned associated transverse cuts. The cuts are arranged in transverse rows and each row includes a plurality of cuts separated by a length of uncut material. The cuts in adjacent rows are longitudinally offset and are arranged to prevent expansion and deformation of the sheet material. Another sheet material that may be used comprises a substantially planar sheet having a plurality of transverse rows of cuts having a non-perpendicular and non-zero angle relative to a longitudinal dimension of the sheet. For further details of such precut stock material and the formation of strips therefrom using only longitudinal severing, reference may be had to U.S. patent application Ser. No. 08/940,610, filed even date herewith and entitled "Method, Machine and Stock Material for Making Folded Strips," which is hereby incorporated herein by reference in its entirety.

Figure 13:
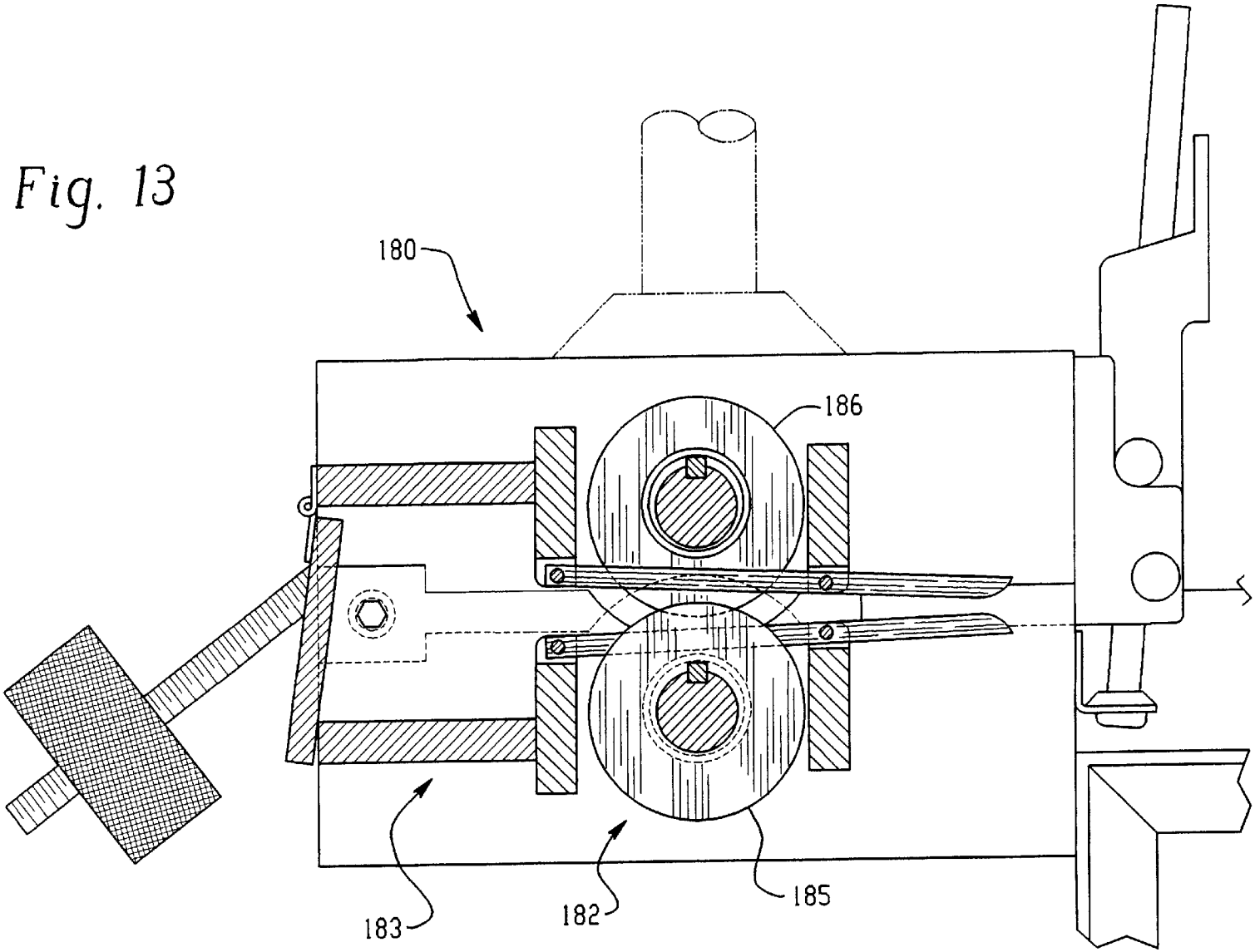
FIG. 13 is a cross-sectional view similar to FIG. 12, but of a further embodiment of conversion machine according to the invention.

In FIG. 13, another embodiment of conversion machine according to another aspect of the invention is designated generally by reference numeral 180. The machine 180 is identical in construction and operation to the machine 160 shown in FIG. 12, except that the upstream pull/feed rollers have been eliminated along with the transverse severing device. Thus, the major components of the machine 180 include a longitudinal severing assembly 182 and a folding assembly 183. The machine 160 is intended for use with pre-transversely severed sheet material. In the machine 180, the slitters 185 and 186 function not only to longitudinally sever the sheet material but also as the primary feeding device for moving the sheet material through the machine. The overlapped slitting discs are operative to feed the sheet material through their interaction.

Although the invention has been shown and described with respect to a certain preferred embodiment or embodiments, equivalent alterations and modifications will occur to others skilled in the art upon the reading and understanding of this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A machine for producing accordion-folded strips from sheet stock material, comprising:

a housing having first and second housing sections;

a longitudinal severing assembly for longitudinally severing the sheet stock material into a plurality of strips, the longitudinal severing assembly including rotatable first and second slitting members; and a folding device downstream of the longitudinal severing assembly operative to cause back and forth folding of the strips to produce accordion-folded strips having substantially uniform adjacent opposite folds; and wherein the first and second housing sections are separable whereby the housing is openable to maintain and repair the machine; and wherein the first slitting member is carried in the first housing section and the second slitting member is carried in the second housing sections;

wherein at least one of said first and second slitting members includes a shaft and an array of slitting discs carried on said shaft for rotation therewith, said slitting discs being individually axially shiftable relative to said shaft.

2. A machine as set forth in claim 1, wherein said first and second slitting members each include a plurality of slitting discs.

3. A machine as set forth in claim 1, wherein said first and second slitting members each include an array of slitting discs that partially overlap and are interleaved with the slitting discs of the other slitting member, and the machine further includes first and second arrays of combers passing through respective spaces between relatively adjacent cutting discs of said first and second slitting members, respectively, the first and second arrays of combers defining therebetween a passageway which directs the sheet stock material between the first and second slitting members, said combers each being in the form of an elongated member having an inner surface defining a part of the passageway and an outer surface disposed inwardly of the rotation axis of the respective slitting member at the same side of said passageway as the comber.

4. A machine as set forth in claim 1, wherein at least one of said first and second slitting members includes a biasing member for resiliently biasing said slitting discs towards one another to hold the slitting discs assembled as a stacked array.

5. A method of producing accordion-folded strips from sheet stock material, comprising the steps of:

coupling together first and second separable sections of a housing of a conversion machine such that first and second slitting members respectively carried in the first and second housing sections are brought into overlapped and interleaved relationship;

supplying sheet stock material to said machine for feeding between the slitting members to produce a plurality of strips of sheet stock material having predetermined unfolded lengths; and causing back and forth folding of the unfolded strips passing from the slitting members to produce accordion-folded strips having substantially uniform adjacent opposite folds;

wherein at least one of said first and second slitting members includes a shaft and an array of slitting discs carried on said shaft for rotation therewith, said slitting discs being individually axially shiftable relative to said shaft.

6. A method as set forth in claim 5, comprising the step of separating the first and second housing sections slitting members for maintenance by separating the first and second housing sections.

* * * * *